US005215054A

United States Patent [19]

Meneely

[11] Patent Number: 5,215,054

[45] Date of Patent: Jun. 1, 1993

[54] VALVE CONTROL APPARATUS AND METHOD

[75] Inventor: Vincent A. Meneely, Langley, Canada

[73] Assignees: Jenara Enterprises Ltd.; Sharlamen Holdings Ltd., both of Surrey, Canada

[21] Appl. No.: 905,569

[22] Filed: Jun. 29, 1992

Related U.S. Application Data

[63] Continuation-in-part of Ser. No. 600,925, Oct. 22, 1990, abandoned.

[51] Int. Cl.[5] ..... F02D 39/02

[52] U.S. Cl. ..... 123/320

[58] Field of Search ..... 123/320, 321, 323, 90.11, 123/90.12, 90.15, 90.16, 90.18

[56] References Cited

U.S. PATENT DOCUMENTS

| | | | |
|---|---|---|---|
| 3,405,699 | 10/1968 | Laas | 123/90.12 |
| 3,707,952 | 1/1973 | Knebel | 123/182 |
| 4,462,353 | 7/1984 | Arai et al. | 123/90.16 |
| 4,466,390 | 8/1984 | Babitzka et al. | 123/90.16 |
| 4,662,332 | 5/1987 | Bergmann et al. | 123/321 |
| 4,664,070 | 5/1987 | Meistrick et al. | 123/321 |
| 4,768,473 | 9/1988 | Yamamoto et al. | 123/323 |
| 4,836,162 | 6/1989 | Melde-Tuczai et al. | 123/321 |
| 4,848,289 | 7/1989 | Meneely | 123/182 |
| 4,870,930 | 10/1989 | Yagi | 123/90.11 |
| 4,922,872 | 5/1990 | Nogami et al. | 123/320 |
| 4,930,471 | 6/1990 | Korner et al. | 123/320 |
| 5,000,146 | 3/1991 | Szucsanyi | 123/321 |
| 5,012,778 | 5/1991 | Pitzi | 123/321 |

FOREIGN PATENT DOCUMENTS

| | | | |
|---|---|---|---|
| 60-3437 | 1/1985 | Japan | 123/320 |

*Primary Examiner*—Raymond A. Nelli
*Attorney, Agent, or Firm*—Norman M. Cameron

[57] ABSTRACT

A valve control apparatus particularly suited for a diesel engine brake. There is an hydraulic actuator having a piston which contacts the valve stem of an exhaust valve. The actuator is independent of the exhaust valve opening mechanism. There is a device, such as an electromagnetically activated valve, which can releasably shut off a flow of fluid from the hydraulic actuator after the exhaust valve is opened by the exhaust valve opening mechanism. The exhaust valve is prevented from closing until a flow of fluid from the hydraulic cylinder is permitted just before top dead center of the compression stroke.

21 Claims, 3 Drawing Sheets

VALVE CONTROL APPARATUS AND METHOD

RELATED APPLICATION

This is a continuation-in-part of Application Ser. No. 07/600,925 filed Oct. 22, 1990, now abandoned.

BACKGROUND OF THE INVENTION

1. Field of the Invention

This invention relates to valve control apparatuses for engines and to diesel engine brakes.

2. Description of Related Art

Internal combustion engines conventionally have at least one exhaust valve and at least one intake valve per cylinder. The opening and closing of the valves is governed by a camshaft which rotates at one half engine speed. In most engines the timing of valve opening and closing cannot be regulated and occurs at fixed points on the engine cycle.

Devices have however been developed to alter valve timing, for example as disclosed in U.S. Pat. No. 4,870,930 to Yagi. Here an electromagnetic solenoid operates on a valve stem to hold the valve open longer than normal.

In U.S. Pat. No. 4,662,332 to Bergmann, an engine brake operates by holding valves open during braking with hydraulic actuators. The device requires pistons large enough to hold the valves open with available oil pressure used as an hydraulic fluid. The device also uses an exhaust restrictor to increase the braking effect.

In U.S. Pat. No. 4,466,390 to Babitzka, a fluid column is interposed between the cam and the valve. Valve timing can be regulated by trapping fluid in the column or allowing it to drain. The complicated arrangement is not well adapted for retrofitting existing engines.

In some engine applications the force available from an electromagnetic device, as disclosed in the Yagi patent, may not be sufficient to hold the valve open. Also Yagi discloses holding the valve open only a relatively brief period on the exhaust stroke and does not conceive of a device where the holding open of the exhaust valve can be utilized for engine braking purposes.

It may be desirable to retrofit engines with valve control apparatuses, for example when adapted for use as a diesel engine brake. Devices such as in the patent to Babitzka are not suitable, as discussed.

SUMMARY OF THE INVENTION

This invention addresses the problem of providing a valve control apparatus suitable for retrofitting engines, and especially for use as an engine brake, by providing an apparatus for a cylinder of the engine having an exhaust valve with a valve stem and a valve opening mechanism. The apparatus includes means for selectively holding the exhaust valve open after the exhaust valve is opened by the exhaust valve opening mechanism. The means includes an hydraulic actuator having an hydraulic cylinder and a piston reciprocally positioned in the hydraulic cylinder. There is means for operatively contacting the valve stem with the piston without interfering with normal operation of the valve opening mechanism. There is means for releasably shutting off a flow of fluid from the hydraulic cylinder, whereby, when the exhaust valve is open, and the piston contacts the valve stem, the exhaust valve is prevented from closing until the flow of fluid from the hydraulic cylinder is allowed.

The invention also provides a combination of an engine braking apparatus and a diesel engine. The apparatus includes means for selectively preventing complete closing of each exhaust valve by the valve spring, after each exhaust valve is opened on the exhaust stroke of its engine cylinder, until near top dead center of the compression stroke. The exhaust valve is released when its engine cylinder is near top dead center of its compression stroke so each exhaust valve is then closed by its valve spring.

The invention also provides a method for braking an engine having a plurality of engine cylinders, each said cylinder having an exhaust valve, each said exhaust valve having an exhaust valve opening mechanism, an exhaust valve spring and an hydraulic actuator having a hydraulic cylinder with a piston operatively biased against said each exhaust valve. The method comprises the steps of opening each said exhaust valve with the exhaust valve opening mechanism; shutting off a flow of hydraulic fluid from each said hydraulic cylinder so the piston holds said each exhaust valve cracked open; and permitting a flow of hydraulic fluid from the hydraulic cylinder near top dead center of each compression stroke of said each cylinder so said each exhaust valve is closed by said exhaust valve spring.

In one embodiment, the exhaust valve of each engine cylinder and an exhaust valve of a second engine cylinder communicate with a common exhaust outlet. There is a selectively operable exhaust restrictor in the exhaust outlet. The second engine cylinder is on the intake stroke when said each cylinder is near top dead center of the compression stroke. The exhaust restrictor in one example of the invention restricts the exhaust gases sufficiently to force exhaust gases into the second cylinder past its exhaust valve when said each cylinder is near top dead center of the compression stroke.

The invention provides several advantages over the prior art. Firstly, it is well adapted for retrofitting standard engines because the hydraulic actuator acts independently of the camshaft and is not interposed between the camshaft and the valve stem as in some prior art. Secondly, the electromagnetic actuator can be relatively small because it only needs to create enough force to shut off the flow of hydraulic fluid from the hydraulic actuator, not the much greater force required to actually hold the exhaust valve open directly as in the patent to Yagi. Also the hydraulic actuator itself can have a much smaller capacity than in Bergmann, for example, because it need not create a force equal to the force of the valve spring and compressed gases in the cylinder to hold the valve open.

The invention provides a compression-release type brake for a diesel engine which does not require a specially timed actuator, such as a push tube for a fuel injector. At the same time it provides better engine braking in some cases than brakes where the exhaust valve remains cracked open throughout all engine cycles.

DESCRIPTION OF THE PREFERRED EMBODIMENTS

Figures 1A, 1B:
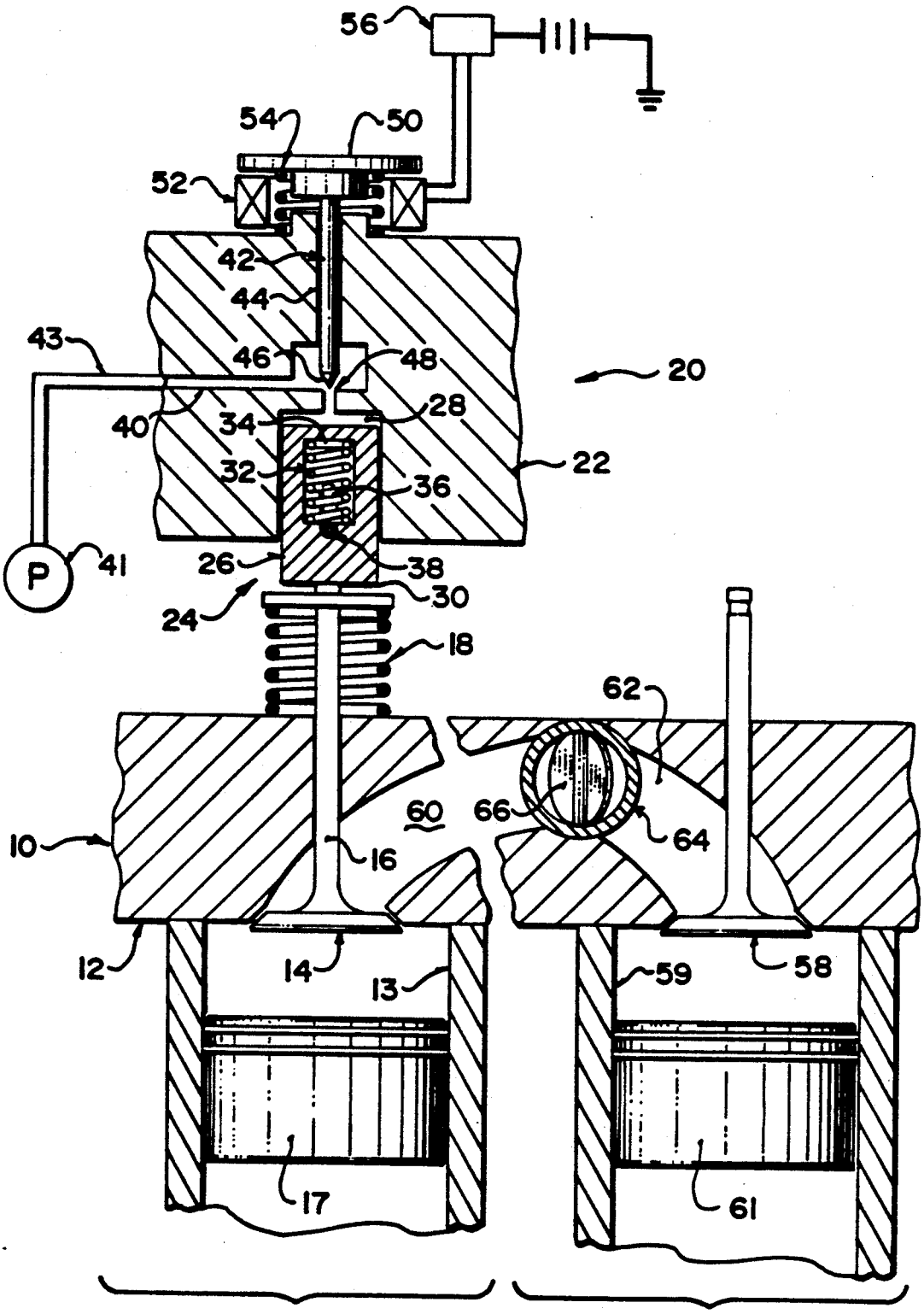
FIG. 1*a* is fragmentary elevation, partly in section, of a valve control apparatus according to one embodiment of the invention, and the associated exhaust valve and portion of the cylinder head.
FIG. 1*b* is a continuation of FIG. 1*a* for a second embodiment of the invention showing a portion of the cylinder head of a second cylinder, an exhaust outlet for the cylinder of FIG. 1 and the second cylinder, and an exhaust restrictor in the outlet.

Referring first to FIG. 1*a*, this shows a fragment of a diesel engine, shown generally at 10, including a portion of its cylinder head 12 and an exhaust valve 14 of one engine cylinder 13 having a piston 17. The exhaust valve is opened on a cyclic basis in the conventional manner by a camshaft which depresses valve stem 16 of the valve against the force of the valve spring 18. The camshaft acts on the valve through a conventional push tube and rocker arm arrangement.

A valve control apparatus is shown generally at 20. In this example the apparatus is a compression release brake and has housing 22, shown in fragment, which is mounted on the cylinder head as is common for compression release brakes.

The housing includes an hydraulic actuator 24, additional actuators being provided for exhaust valves of other engine cylinders. The actuator includes a piston 26 which is reciprocally positioned in hydraulic cylinder 28. The piston has a bottom end 30 which contacts valve stem 16.

For simplicity the conventional valve opening mechanism of the engine is omitted in FIG. 1*a*, 1*b*, 2 and 3. FIG. 4 however, where like parts have like numbers with ".4" and ".5" added, shows how piston 26.4 operates independently of the conventional valve opening mechanism 27 of the engine which includes rocker arm 29. In this example the piston has a bifurcated lower portion 31 which contacts crosshead 33 which in turn contacts two exhaust valves 14.4 and 14.5. Other known arrangements may be used for other configurations of valves. The bifurcated lower portion of the piston straddles the rocker arm and so does not interfere with its normal operation.

There is a return coil spring 32 located in a cylindrical recess 34 within the piston as seen in FIG. 1*a*. A vertically elongated slot 36 extends diametrically through the piston. A pin 38 extends through the slot and is fixedly secured to the housing 22. This pin serves to limit travel of the piston towards the exhaust valve while the spring resiliently biases the piston away from the valve.

A conduit 40 extends through the housing to hydraulic cylinder 28 and is connected to oil pump 41 of the lubricating oil lines 43 of the engine so the pressurized oil acts as hydraulic fluid for cylinder 28.

A needle valve 42 is slidably received in a bore 44 through the housing and has a pointed end 46 capable of sealingly engaging valve seat 48 between conduit 40 and cylinder 28 and therefore can serve as means for releasably shutting off a flow of fluid from the cylinder 28.

A disc 50, of steel or other magnetic material, is connected to the top of the needle valve. An electromagnetic actuator or solenoid 52 is located between the disc and the housing. A coil spring 54, located between the disc and the housing, biases the needle valve away from its seat 48 as shown.

A control unit 56 supplies electrical current to solenoid 52 when it is desired to keep valve 14 open beyond its normal timed closing.

In operation, when employed as a compression release brake, control unit 56 supplies current to solenoid 52 during the exhaust stroke of cylinder 13. The valve 14 is open at this time. The solenoid attracts disc 50 downwards, thus pressing the needle valve against its seat 48 and shutting off the flow of oil from cylinder 28 to conduit 40. The maximum downward movement of piston 26, which occurs when pin 38 contacts the top of slot 36, is such that the valve is kept cracked open a relatively small distance compared to its normal maximum opening.

Current is supplied to the solenoid 52 throughout the intake stroke of cylinder 13 and throughout its compression stroke so piston 26 holds valve 14 open past the exhaust stroke until the piston 17 is near top dead center of the compression stroke. At that point control unit 56 cuts off electrical current to solenoid 52. Spring 54 then acts to raise needle valve 42 off its seat 48 and thus allow oil to exit from cylinder 28 through conduit 40. This permits valve spring 18 to move piston 26 upwards, away from the valve 14 and closes the valve.

FIG. 1*b* illustrates an alternative embodiment of the invention and is a continuation of FIG. 1*a*. In this example valve 14 and a second exhaust valve 58 have exhaust ports 60 and 62 respectively which are connected to a common exhaust conduit 64. One common arrangement in an eight cylinder engine is to provide two banks of four cylinders each. Each bank of cylinders has a common exhaust outlet. Piston 61 of cylinder 59 is on the intake stroke when cylinder 13 approaches top dead center of its compression stroke.

There is an adjustable exhaust gas restrictor 66, in the form of a butterfly valve in this example, in exhaust conduit 64. The restrictor is closed during engine brake operation to partially block conduit 64 and thus increase the braking effect as the exhaust gases are forced past the restrictor. In this example the restrictor creates a back pressure of exhaust gases great enough to force open valve 58 when the cylinder 13 is near top dead center of its compression stroke. At that time a pressure pulse is created in the exhaust system from cracked open valve 14. The pulse is transmitted to valve 58 and opens the valve beyond its normally cracked-open position and forces exhaust gases into its cylinder 59. This increases the charge in the cylinder and thereby the braking effect on its compression stroke. Another cylinder creates the same effect for cylinder 13 and other cylinders of the engine.

Figure 2:
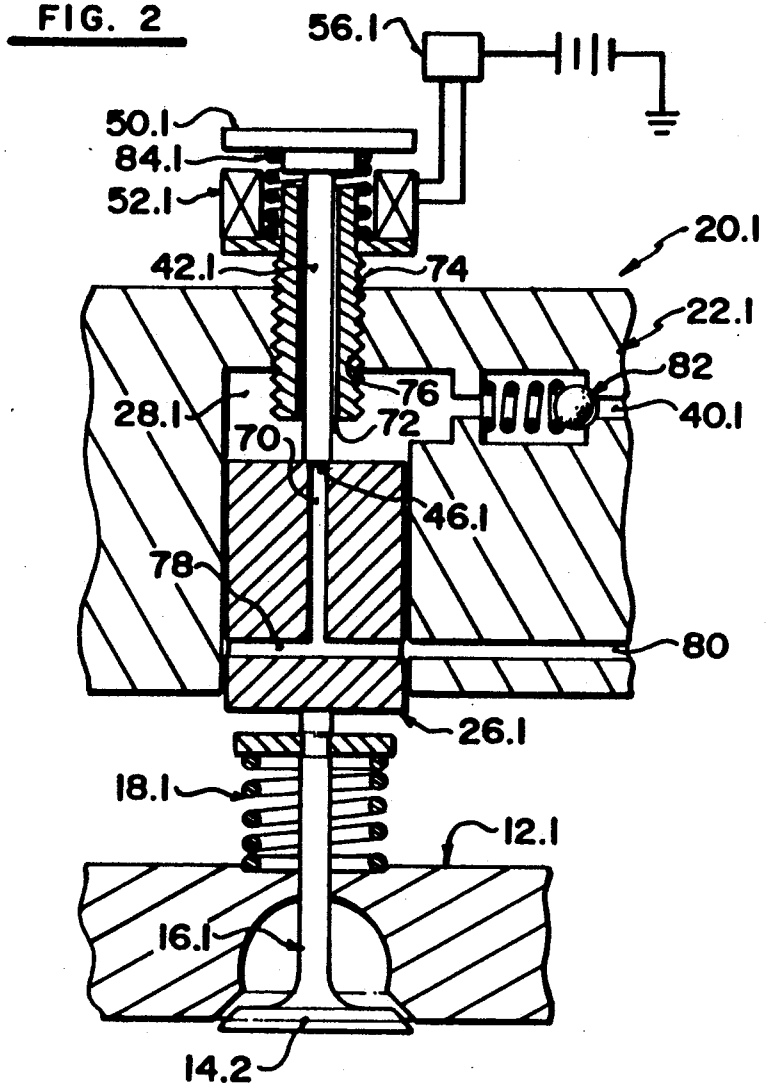
FIG. 2 is a fragmentary elevation, partly in section, of a valve control apparatus according to a third embodiment of the invention.

Referring to FIG. 2, this is another embodiment of the invention with provision for adjusting the amount the valve is cracked open. Parts corresponding to those in FIG. 1 have the same number with the addition of "0.1". The structure and operation are similar except as described below.

In this example a valve member 42.1 replaces the needle valve of the first two embodiments. Its end 46.1 is blunt and is adapted to sealingly contact the top of the piston 26.1 to block a flow of oil from conduit 70 which extends axially from the top of piston 26.1. Valve member 42.1 fits slidingly through central bore 72 in an adjustment screw 74 which threadedly engages a complementary threaded opening 76 in housing 22.1. Solenoid 52.1 is mounted on top of adjustment screw 74. The piston 26.1 also has diametrical conduit 78 communicating with conduit 70 which, in the illustrated position of the piston, is aligned with an oil drain 80 in the housing. In this embodiment pressurized oil is supplied from the engine oil pump through conduit 40.1. Conduit 40.1 has a check valve 82 therein which blocks a flow of oil away from cylinder 28.1.

When operated by means of control unit 56.1, current is supplied to solenoid 52.1 during the exhaust stroke of the engine cylinder associated with valve 14.1. The distal end 46.1 of member 42.1 projects into cylinder 28.1 towards piston 26.1 and is adjustable by rotating the screw 74. The adjustment is made such that, when moved downwardly by a solenoid 52.1, the member 42.1 maintains piston 26.1 at a distance which is the sum of (1) the lash (freeplay) between piston 26.1 and the valve stem when the valve is closed and (2) the distance the valve is to be cracked open. Oil from conduit 40.1 fills cylinder 28.1 above piston 26.1 and moves the piston towards valve 14.1. If the top of the piston moves below end 46.1 of member 42.1, then oil from the cylinder 28.1 drains through conduits 70 and 78 to drain 80.

When the exhaust stroke is finished, valve 14.1 attempts to close under the action of spring 18.1. However, once the top of piston 26.1 contacts end 46.1 of the member 42.1, further upward movement is prevented by the oil trapped in cylinder 28.1 between the top of piston 26.1 and check valve 82. The solenoid 52.1 is deactivated by control unit 56.1 near top dead center of the compression stroke of the relevant engine cylinder. Spring 84 then moves member 42.1 away from piston 26.1, allowing oil in cylinder 28.1 to flow out through bores 70 and 78 and drain 80. This allows piston 26.1 to move up and the valve 14.1 to close.

Figure 3:
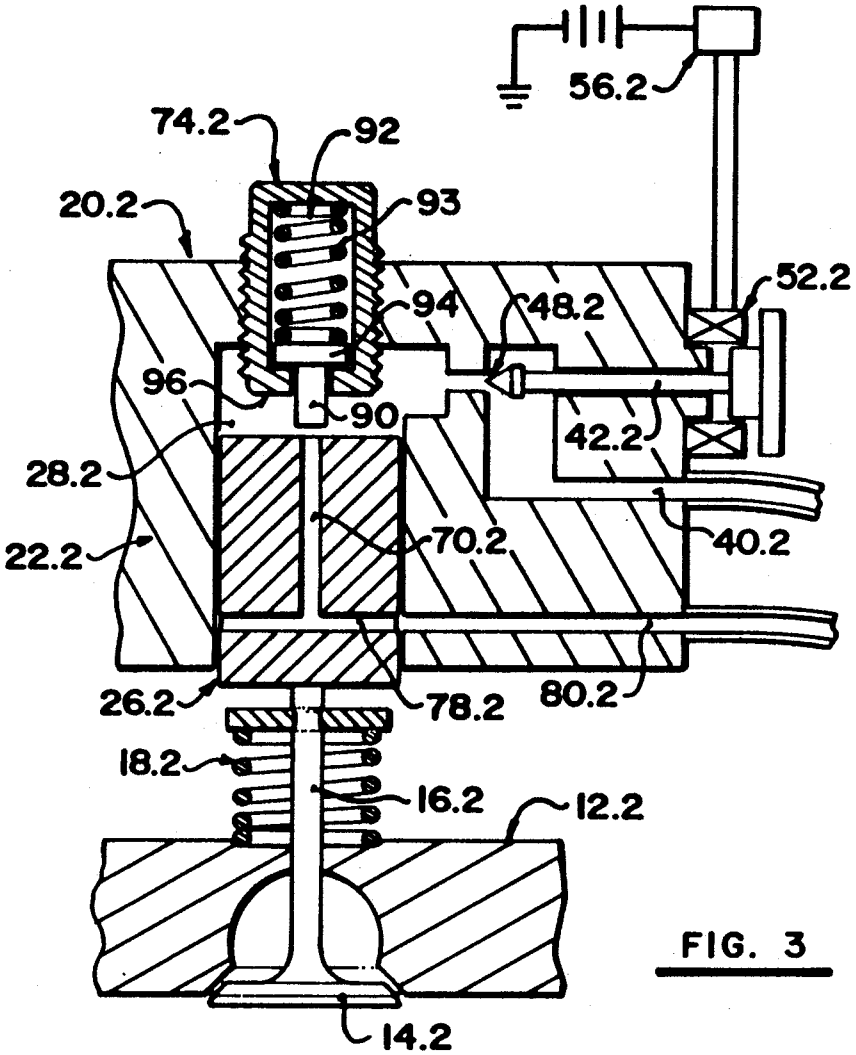
FIG. 3 is a view, similar to FIG. 2, of a fourth embodiment of the invention.
Figure 4:
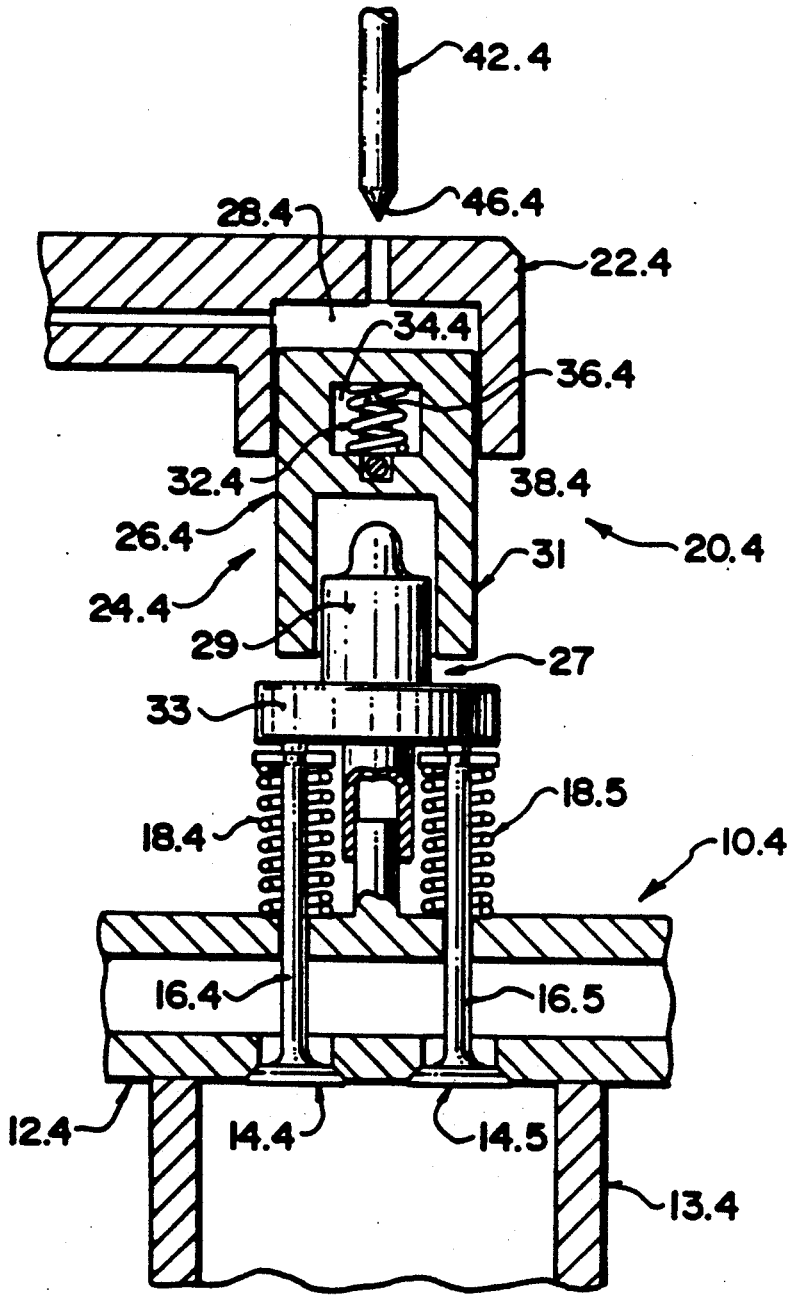
FIG. 4 is fragmentary side elevation, partly in section, of the piston of the valve control apparatus together with the conventional valve opening mechanism of an engine.

FIG. 3 shows a fourth embodiment of the invention where like parts have like numbers to FIG. 1 and FIG. 2 with the additional designation "0.2". This example functions generally similar to that of FIG. 2 except that the adjustment screw is separated from the solenoid 52.2. The solenoid is displaced to one side and retains a needle valve 42.2 with a seat 48.2 similar to FIG. 1.

Adjustment screw 74.2 has an interior hollow 92 with a coil spring 93 therein. A moveable finger 90 projects from the interior of the screw and has an enlarged top 94 which is retained within the screw by annular flange 96 thereof. Spring 93 biases the finger downwardly.

As with the embodiment of FIG. 2, the screw is adjusted so that the finger contacts the top of piston 26.2 until the piston has moved down a distance sufficient to take up lash in the system and keep the valve cracked open the desired amount. It works similarly as well except the oil is trapped in the cylinder 28.2 by the finger 90 contacting the top of conduit 70.2 and by needle valve 42.2 contacting its seat 48.2. When the piston of the relevant cylinder is near top dead center of its compression stroke, control unit 56 deactivates the solenoid so the pressurized oil moves the needle valve 42.2 off its seat. Valve spring 18.2 then can move the piston 26.2 upwardly displacing oil into conduit 40.2 so the valve 14.2 can close.

By way of further example, the invention also includes embodiments where other means is employed as a trigger or release mechanism in place of the solenoids of the previous examples. For instance a mechanical trigger could be used and actuated by an engine valve or fuel injector mechanism.

The description above and the drawings are by way of example only. The invention includes modifications within the scope of the following claims.

What is claimed is:

1. A valve control apparatus for an engine cylinder of a four stroke internal combustion engine, said cylinder having an exhaust valve with a valve stem and an exhaust valve opening mechanism, the apparatus comprising:

means for selectively holding said exhaust valve open past the exhaust stroke after said exhaust valve is opened by the exhaust valve opening mechanism, said means including an hydraulic actuator having an hydraulic cylinder and a piston reciprocally positioned in the hydraulic cylinder, means for operatively contacting the valve stem with said piston without interfering with normal operation of the valve opening mechanism, and means for releasably shutting off a flow of fluid from the hydraulic cylinder, whereby, when said exhaust valve is open and the piston operatively contacts the valve stem, said exhaust valve is prevented from closing until said means for releasably shutting off is released, to allow a flow of fluid from the hydraulic cylinder.

2. An apparatus as claimed in claim 1, wherein the means for releasably shutting off is a valve actuated by an electromagnetic actuator.

3. An apparatus as claimed in claim 2, wherein the means for operatively contacting includes a bifurcated portion of the piston.

4. An apparatus as claimed in claim 1, wherein said means for releasably shutting off shuts off a flow of fluid from the hydraulic cylinder before said exhaust valve is completely closed on each exhaust stroke, thereby holding said exhaust valve cracked open, and releases when the engine cylinder is near top dead center of the compression stroke, thereby allowing said exhaust valve to close.

5. In combination:

an engine braking apparatus and a diesel engine having a plurality of engine cylinders, each said cylinder having an exhaust valve with a valve stem and a valve spring, and an exhaust valve opening mechanism for opening said exhaust valves, the apparatus comprising means for selectively preventing complete closing of each said exhaust valve by the valve spring after each said exhaust valve is opened by the exhaust valve opening mechanism, and for releasing said each exhaust valve when its engine cylinder is near top dead center of the compression stroke so said each exhaust valve is then closed by the valve spring thereof.

6. A combination as claimed in claim 5, wherein the means for selectively preventing complete closing includes an hydraulic actuator having a piston operatively contacting the stem of said each exhaust valve and an hydraulic cylinder reciprocally receiving said piston, and means for shutting off an outflow of hydraulic fluid from the hydraulic cylinder, thereby holding the piston against the valve stem.

7. A combination as claimed in claim 5, wherein the means for selectively preventing holds said each valve cracked open a smaller distance than maximum valve opening distance on the exhaust stroke.

8. A combination as claimed in claim 6, further including a conduit for admitting pressurized hydraulic fluid into the hydraulic cylinder, the means for shutting off comprising a shut off valve in said conduit.

9. A combination as claimed in claim 8, wherein the shut off valve has an electromagnetic actuator.

10. A combination as claimed in claim 8, wherein the shut off valve is a needle valve.

11. A combination as claimed in claim 6, further including means for resiliently biasing the piston away from said each exhaust valve.

12. A combination as claimed in claim 6, further including means for limiting travel of the piston towards the exhaust valve.

13. A combination as claimed in claim 6, wherein the engine has an exhaust outlet, said each exhaust valve of said each engine cylinder and another said exhaust valve of another said engine cylinder communicating with the exhaust outlet, and a selectively operable exhaust restrictor in said exhaust outlet, said another engine cylinder being on the intake stroke when said each engine cylinder is near top dead center of the compression stroke.

14. A combination as claimed in claim 13, wherein the exhaust restrictor restricts the exhaust gases sufficiently to force exhaust gases into said another cylinder past said another exhaust valve when said each engine cylinder is near top dead center of the compression stroke and said another cylinder is on the intake stroke.

15. A combination as claimed in claim 6, wherein the means for selectively preventing complete closing is adjustable to vary the distance said each exhaust valve is held open.

16. A combination as claimed in claim 15, further including a drain for hydraulic fluid and a conduit through the piston communicating with the drain when the exhaust valve is open and the piston is against the valve stem of the exhaust valve, the means for shutting off an outflow of hydraulic fluid including means for sealing the conduit through the piston.

17. A combination as claimed in claim 16, wherein the conduit through the piston communicates with an end of the piston opposite the exhaust valve, the means for sealing thereby blocking the conduit at said end of the piston, the means for sealing being adjustably moveable towards or away from the piston.

18. A combination as claimed in claim 17, wherein the apparatus has a housing, the means for sealing being mounted on a threaded member which threadedly engages the housing.

19. A combination as claimed in claim 18, wherein the means for sealing comprises a valve member and an electromagnetic actuator for moving the valve member towards the piston to seal the conduit when the apparatus is in operation.

20. A combination as claimed in claim 18, wherein the means for sealing comprises a valve member and means for biasing the valve member towards the piston to seal the conduit when the apparatus is in operation, the means for shutting off and releasing also including an electromagnetically actuated valve means for permitting an outflow of hydraulic fluid from the hydraulic cylinder when the engine cylinder is near top dead center of the compression stroke and when the apparatus is not operational.

21. A method for braking an engine having a plurality of engine cylinders, each said cylinder having an exhaust valve, each said exhaust valve having an exhaust valve opening mechanism, an exhaust valve spring and an hydraulic actuator having a hydraulic cylinder with a piston operatively biased against said each exhaust valve, the method comprising the steps of:

opening each said exhaust valve with the exhaust valve opening mechanism;

then shutting off a flow of hydraulic fluid from each said hydraulic cylinder so the piston holds said each exhaust valve cracked open; and permitting a flow of hydraulic fluid from the hydraulic cylinder near top dead center of each compression stroke of said each cylinder so said each exhaust valve is closed by said exhaust valve spring.

* * * * *